US005943733A

United States Patent [19]

Tagliaferri

[11] Patent Number: 5,943,733

[45] Date of Patent: Aug. 31, 1999

[54] SUCKING AND FILTERING VEHICLE FOR DUST AND TRASH COLLECTING

[75] Inventor: Fabrizio Tagliaferri, Trecasali, Italy

[73] Assignee: Dulevo International S.p.A., Parma, Italy

[21] Appl. No.: 08/625,300

[22] Filed: Apr. 1, 1996

[30] Foreign Application Priority Data

Mar. 31, 1995 [IT] Italy ..... MI950224 U

[51] Int. Cl.[6] ..... A47L 11/202

[52] U.S. Cl. ..... 15/340.4; 15/347; 15/349

[58] Field of Search ..... 15/340.3, 340.4, 15/347, 349

[56] References Cited

U.S. PATENT DOCUMENTS

| | | | |
|---|---|---|---|
| 3,304,572 | 2/1967 | Wendel | 15/352 X |
| 3,639,940 | 2/1972 | Carlson et al. | 15/349 X |
| 4,219,901 | 9/1980 | Burgoon et al. | 15/352 |
| 4,310,944 | 1/1982 | Kroll et al. | 15/349 X |
| 4,514,875 | 5/1985 | Comer | 15/349 |
| 5,090,083 | 2/1992 | Wulff | 15/349 X |
| 5,093,955 | 3/1992 | Blehert et al. | 15/349 X |

FOREIGN PATENT DOCUMENTS

| | | |
|---|---|---|
| 0291844 | 11/1988 | European Pat. Off. . |
| 0453177 | 10/1991 | European Pat. Off. . |
| 1264477 | 3/1968 | Germany . |
| 973178 | 10/1964 | United Kingdom . |

*Primary Examiner*—Chris K. Moore
*Attorney, Agent, or Firm*—Browdy and Neimark

[57] ABSTRACT

A sucking and filtering vehicle for dust and trash collecting is provided which comprises wheels (3), driving and steering means (4), dust and trash collecting and transporting means (5) comprising a tank (6), and suction device (7) adapted to form an air stream under suction passing through the tank (6), at least one filter (10) placed along the air stream under suction, and a chamber (13) external to the tank (6) and in communication therewith and housing at least one prevailing portion of the filter (10), the chamber (13) having walls (13*a*) at least partly spaced apart from said filter (10) in such a manner as to define hollow spaces or gaps (17) around the filter (10), the suction device (7) opening into said gaps (17).

9 Claims, 2 Drawing Sheets

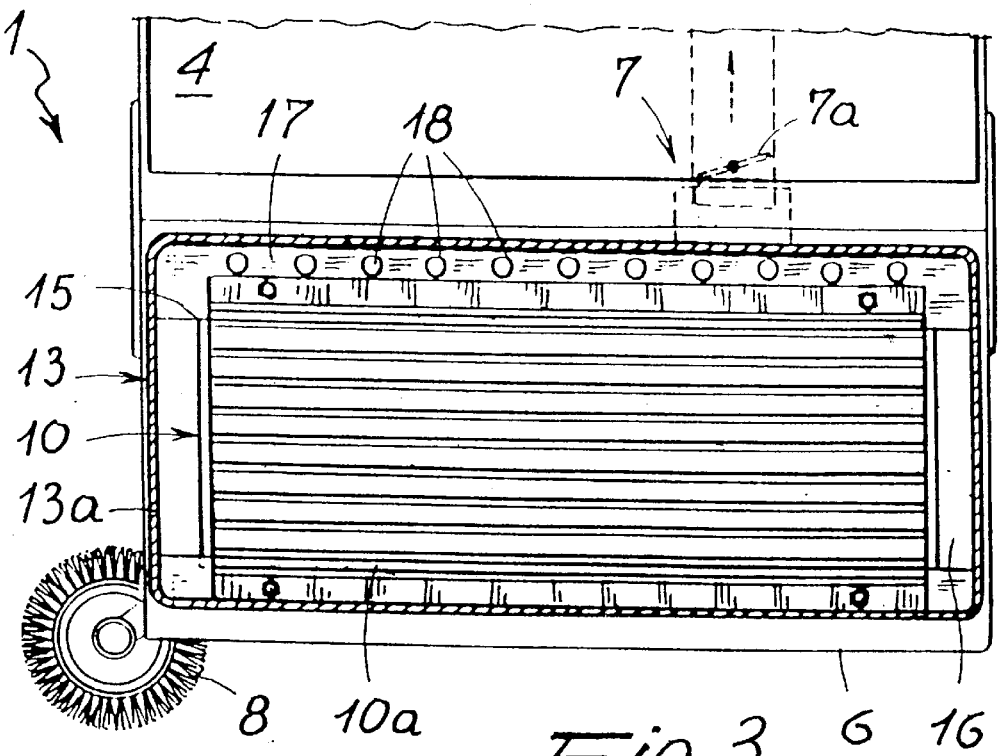
Fig. 3
Fig. 4
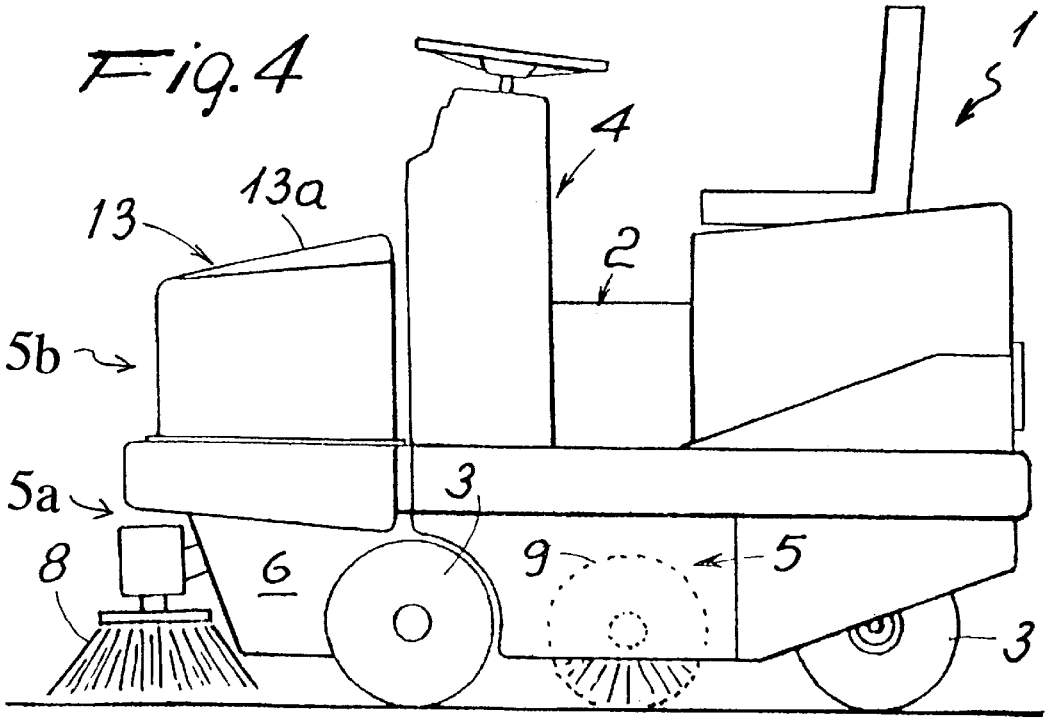

SUCKING AND FILTERING VEHICLE FOR DUST AND TRASH COLLECTING

BACKGROUND OF THE INVENTION

The present invention relates to a sucking and filtering vehicle for dust and trash collecting, such as a sweeper machine for industrial and commercial areas or street surfaces.

It is known that suction means arranged in sweeper vehicles or machines of the above type act in synergy with other members such as brushes and rollers acting on the ground and have the task of moving a large mass of air.

This air drawn in by the suction means is necessarily filtered before being discharged to the surrounding atmosphere.

Filtering takes place by means of members that must comply with at least two requirements: they must define wide filtering surfaces and be adapted to be efficiently recleaned, also while the vehicle is moving, in order to avoid work being stopped due to clogging of the filtering surfaces.

In order to meet the first requirement, a so-called "pocket" filter is used, which is made of an acrylic fabric as large as many square meters which is disposed in a folded configuration so as to form several loops or pockets. These loops or pockets are disposed in side by side relation, to define overall dimensions consistent with the sweeper machine sizes, and are maintained in place by appropriate tie-rods.

For meeting the second requirement, the filter is positioned in the same container or tank in which building up of dust and trash takes place and, in addition, at least one shaker member is provided close to the filter, said shaker being capable of shaking the filter to cause dust stored on the filtering surfaces to fall into the tank itself. Practically, within the tank the filter is placed below a sucking pipe passing through the tank cover for example, and above said shaker member.

This technical solution taken as a whole has the quality of making available large filtering surfaces gathered to form a relatively reduced volume, and to remedy clogging which is a drawback of filtering surfaces, making dust stored on said surfaces fall into the tank.

There are however several drawbacks.

A first drawback can be identified by the fact that sweeper vehicles or machines of the above specified structure are limited in terms of available construction solutions, as it is always necessary that the air suction ducts should terminate on top of the tank, above the filtering means, in turn hanging from the upper portion of the tank.

Another drawback resides in that filtering surfaces are not utilized at best, because suction is always carried out in a single direction, in particular the direction facing the tank top, so that some areas of the filtering units are more engaged and utilized than others.

Another drawback of great importance is represented by the fact that the filtering surfaces tend to get continuously clogged, because they are located within the tank or trash container, where due to the continuous introduction of material, turbulence and presence of dust are very high. So it may happen that also particles of dust of great sizes that should be intended for laying on the tank bottom, due to said turbulence may accidentally rest on the filtering surfaces.

The continuous clogging of the filtering surfaces causes a more reduced filter efficiency, even in the presence of a frequent activation of said shaker member.

SUMMARY OF THE INVENTION

Under this situation, it is an object of the present invention to devise a sucking and filtering vehicle capable of substantially obviating the above drawbacks.

This object is substantially achieved by a sucking and filtering vehicle for dust and trash collecting or gathering comprising: wheels resting on the ground, driving and steering means governing the vehicle running, means for collecting and transporting dust and trash including at least one tank and suction means adapted to form an air stream under suction passing through said tank, and at least one filter placed along said air stream under suction and adapted to clean the air, and comprising a chamber external to said tank and in communication therewith and adapted to house at least one prevailing portion of said filter in a protected position, said chamber having walls at least partly spaced apart from said filter and defining free hollow spaces or gaps about said filter, and said suction members opening into said gaps in a manner adapted to form an air stream under suction substantially surrounding said filter.

BRIEF DESCRIPTION OF THE DRAWING

The description of a vehicle according to the invention is now given, by way of non-limiting example, with reference to the accompanying drawings, in which:

FIG. 3 is a plant view of the vehicle portion shown in FIG. 1; and

FIG. 4 shows an overall vehicle structure.

DETAILED DESCRIPTION OF THE INVENTION

Figure 1:
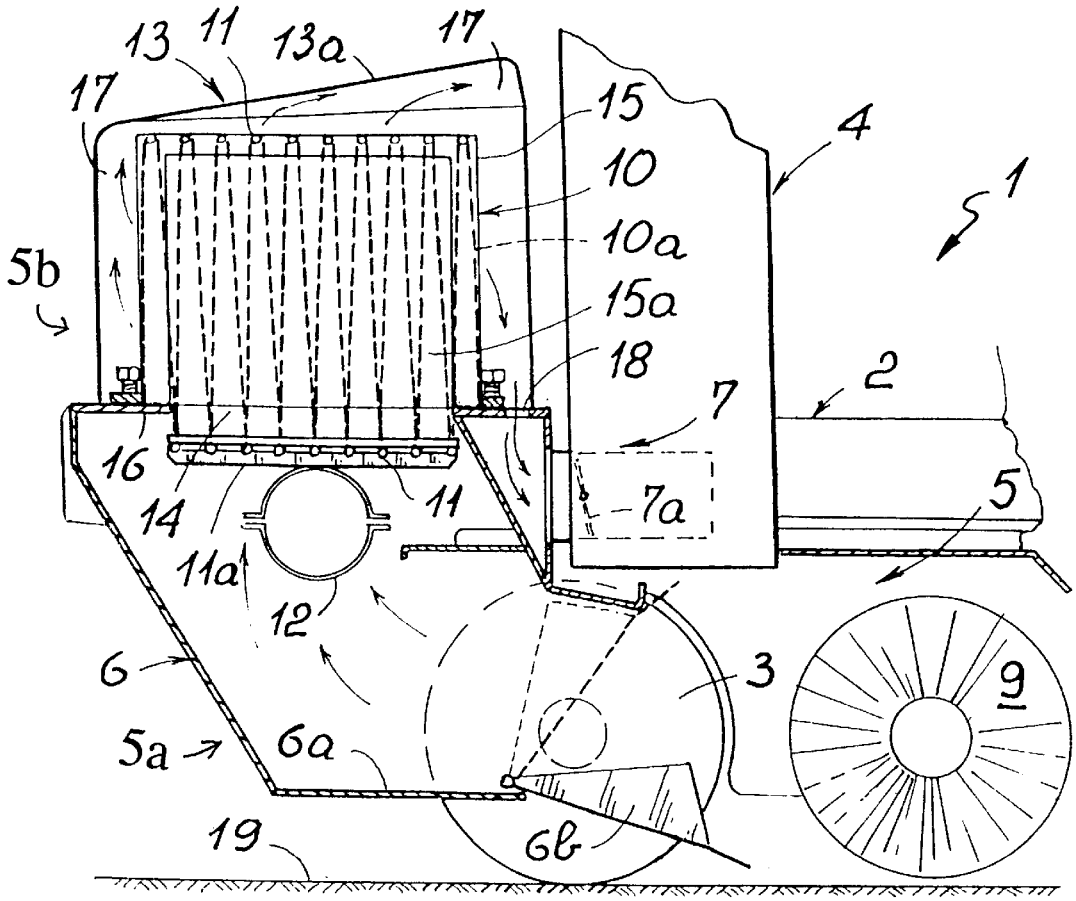
FIG. 1 is a sectional view of the vehicle portion where the means for collecting and transporting dust and trash as well as a cleaning filter are located.
Figure 2:
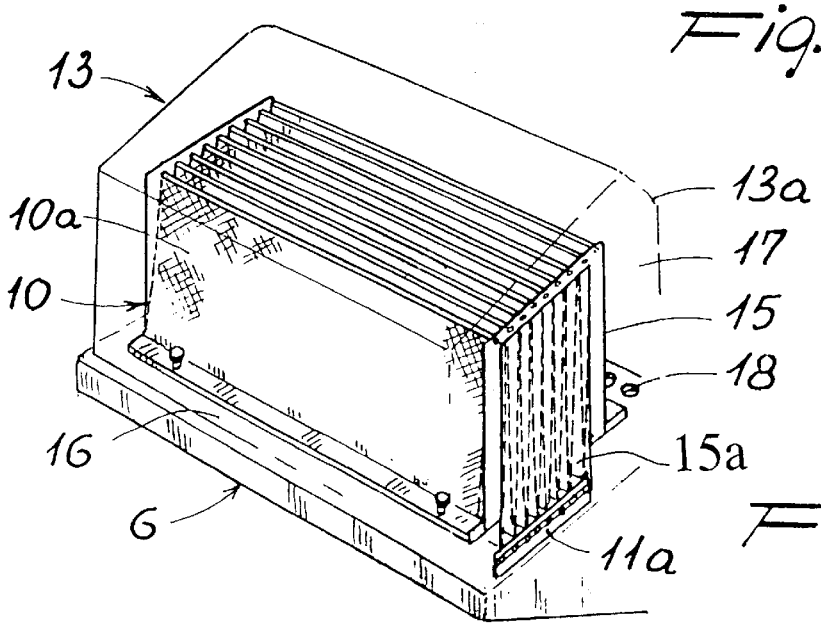
FIG. 2 is a perspective view of said filter.

With reference to the drawings, the sweeper vehicle or machine according to the invention is denoted by reference 1. It comprises, as shown in FIG. 4, supporting means for collecting and transporting dust and trash 5, including means for transporting dust and trash 5*a* and means for collecting dust and trash 5*b*. The means for transporting dust and trash 5*a* comprises a chassis 2 supported by wheels 3 for contact with the ground. The vehicle running is controlled in a manner known per se by driving and steering means 4.

The means for transporting dust and trash 5*a* further comprises a tank 6, supported by the chassis 2, for storage of dust and trash. The means for collecting dust and trash 5*b* comprises a suction device 7 adapted to form an air stream under suction passing through the tank 6. The suction device 7 terminates at a fan and has channels for the drawn in air to be controlled by a throttle valve 7*a*.

The means for collecting dust and trash 5*b* is also provided to comprise a brush in the form of a cup or a truncated cone 8 placed ahead of the chassis 2, and a roller brush 9 placed before a loading port of the tank 6.

The roller brush 9 is adapted to throw dust and trash with great energy to the inside of tank 6, said tank having a bed 6*a* close to the ground level and a closing door 6*b* facing the roller brush and movable between a sealingly closed position and an open position in which it forms a guide or chute for the material thrown by the roller brush 9. Also provided is filtering means comprising a filter 10 of the so-called pocket type, intended for cleaning of the air within the tank 6 and placed in said air stream under suction.

This filter 10 is substantially made of a porous fabric, in particular an acrylic fabric the filtering surface of which is as large as many square metres and is capable of filtering particles of very small size too. The fabric is such folded as to form loops or pockets in side by side relation with each other and suitably stretched; small rods 11 are inserted in the fabric folds.

Filter 10 is associated with shaker members 12 adapted to avoid clogging of the filtering surfaces. Diagrammatically shown in FIG. 1 is a support for these shaker members which are known and substantially consist of an eccentric or unbalanced mass that, when rotated, causes oscillation of filter 10.

Advantageously, the vehicle 1 is comprised of a chamber 13 placed externally of the tank 6 and provided with walls 13*a* of its own disposed in such a way that they give the chamber 13 a volume large enough to house at least one upper main portion of filter 10.

The suction chamber 13 communicates both with the suction device 7 and the tank 6.

The chamber 13 is at a raised position with respect to the tank bed 6*a* and has a base 16 in which an opening 14 for communication with the tank 6 is formed.

In the embodiment shown, the chamber 13 is also placed above the tank 6 and the base 16 is a portion of an upper wall of the tank 6, whereas the walls 13*a* are defined by a cap or cover that can be easily removed for full access to the filter 10. Arranged in chamber 13 are support elements 15 for the filter 10. As shown in the figures, the upper end of filter 10 is hanging from the support elements 15 consisting of posts emerging from the base 16, by engagement of the ends of the upper small rods 11 fitted in the upper folds.

The filter at its lower portion can freely oscillate because the lower small rods 11, fitted in the lower folds, are only connected with each other by crosspieces 11*a*.

It is to note that posts 15 are also associated with flanks or sides 15*a* laterally closing the filter 10 flaps that otherwise would remain open and would define an undesired direct passage for the air under suction from the tank 6 to the suction device 7 without a previous air passage through the pocket filter.

Filter 10 as shown has the characteristic feature of expanding at the lower portion thereof until it engages the opening 14 by its oscillating lower portion and in addition it also partly expands in the tank 6.

Thus, said shaker members 12 are fitted in the tank 6 and act by causing oscillation of the filter bottom portion facing the tank 6. In particular the shaker members 12 act on the crosspieces 11*a*.

However filter 10 is mostly held at the inside of chamber 13 and is substantially placed in the middle of same, so as to leave free gaps 17 close to the walls 13*a*.

The suction device 7 opens into chamber 13 by a plurality of suction inlets 18 located close to the base 16 and gaps 17. However suction inlets 18 may also be provided at any point in chamber 13.

In the embodiment shown, filter 10 also has the particular feature of having end flaps 10*a* fastened to the base 16. Practically, the end flaps 10*a* define opposed filtering flanks substantially vertical which, being fastened to the base 16, leave the gaps 17 free over the whole height of the walls 13*a*.

Thus, the air stream under suction surrounds the upper main portion of the filter 10 and be more efficient both at the tank 6 level and at the ground level, identified by 19, where brushes 8 and 9 are in operation.

Operation of the vehicle is as follows.

The sweeper vehicle or machine 1 has a large filtering surface and said surface can be shaken by a shaker 12 to let dust fall into the tank 6.

However, intervention of shaker 12 can be occasional and it may be also replaced by a manual intervention at the end of the work cycle, in that the filtering surface is protected and is not impinged on by the turbulence existing in tank 6, as it is mostly located at the outside of said tank.

The external position of chamber 13 enables the same to be oversized and the filter 10 to be placed between large free gaps. Opening into these gaps are the suction inlets 18 and therefore chamber 13 allows the presence of an air stream under suction surrounding the upper main portion of the filter 10 on many sides. In any case said suction inlets can be also disposed in any position close to the gaps 17.

Due to this fact, a wide selection is allowed when the position, sizes, structure and shape of the suction device 7 is to be planned, which suction device is critical for a good operation of the machine.

The suction device 7 is also more efficient in that it does not require long pipes, giving rise to flow resistances, until the upper end of filter 10, and in that suction requires less effort, since the air streams can substantially flow out of filter 10 according to plural directions, following the route that by turns is actually less clogged or easier.

In addition, not only the filter is protected against quick cloggings and damages due to throwing of the trash against it, but it is also best utilized, in that the air streams under suction substantially engage the filtering surfaces from all sides in the same manner.

Thus vehicle 1 reaches important operating advantages as regards its capability of sucking and filtering air. It should be also noted that servicing or replacement of filter 10 does no longer need access to the inside of tank 6, which will cause the risk of spreading the dust contained therein in the surrounding atmosphere.

The manual shaking of the filter can also be carried out from the outside, without any risks of pollution.

Finally, storage of dust and trash at the inside of the vehicle tank 6 can be carried out in a more efficient manner, since the tank capacity is not reduced by the presence of filter 10 and it is possible to throw dust and trash with the greatest energy into the tank 6, by means of roller 9, due to the fact that all risks of damaging the filter 10 are eliminated.

I claim:

1. A sucking and filtering vehicle for gathering dust and trash, comprising;

wheels (3) for contact with the ground (19);

driving and steering means (4) for running the vehicle (1);

means for collecting (5*b*) and transporting (5*a*) the dust and trash including at least one tank (6) and a suction device (7) adapted to form an air stream under suction passing through said tank (6);

at least one filter (10) placed in said air stream under suction and adapted to clean the air stream;

a chamber (13) external to said tank (6) and in communication therewith and adapted to house therein an upper main portion of said filter (10), said chamber (13) having walls (13*a*) at least partially spaced apart from said filter (10) and defining free gaps (17) around said filter (10), and said suction device (7) communicating with said gaps (17) and causing the air stream to pass through said filter (10);

said tank (6) including a bed (6*a*) close to the ground (19);

said chamber (13) being at a raised position with respect to said bed (6*a*);

and further comprising:

shaker members (12) active on said filter (10), said shaker members (12) being adapted to drop dust built up on said filter (10) into said bed (6*a*);

and wherein a lower portion of said filter (10) extends from said chamber (13) partly into said tank (6), and said shaker members (12) are disposed in said tank (6).

2. The vehicle as claimed claim 1, in which said chamber (13) internally has support elements (15) and in which said filter (10) is a pocket filter hanging from said support elements (15), and in which said chamber (13) has a base (16) and an opening (14) formed in said base (16) and in communication with said tank (6), and in which said pocket filter has end flaps **(10*a*) fastened to said base (16), said gaps (17) extending around said filter (10) starting from said base (16) of said chamber (13)**.

3. The vehicle as claimed in claim 1, in which said suction device (7) has a plurality of suction inlets (18) positioned and distributed in said chamber (13) so as to open into said gap (17).

4. A sucking and filtering vehicle for gathering dust and trash, comprising:

means for collecting and transporting the dust and trash including a roller brush for gathering dust and trash from ground, at least one tank for housing the gathered dust and trash, and suction device for forming an air stream under suction passing through said tank;

a chamber external to said tank and having a base and an opening formed in said base, said chamber being in communication with said tank through said opening;

at least one filter placed in said air stream under suction for cleaning said air stream;

said filter having an upper main portion located in said chamber above said opening and extending from said chamber partly into said tank through said opening, whereby a lower portion of said filter is located in said tank below said opening;

said chamber having walls spaced apart from said upper main portion of said filter and defining free gaps around said upper main portion of said filter;

said suction device communication with said gaps and causing said air stream under suction to pass through said upper main portion of said filter according to plural directions.

5. The vehicle as claimed in claim 4, comprising shaker members active on said filter for causing dust built up on said filter to drop into said tank, said shaker members being disposed in said tank and engaging said lower portion of said filter.

6. The vehicle as claimed in claim 4, in which said chamber internally has support elements and in which said filter is a pocket filter hanging from said support elements.

7. The vehicle as claimed in claim 6, in which said pocket filter has end flaps fastened to said base, and in which said gaps are defined by said end flaps of said pocket filter, said base and said walls of said chamber.

8. The vehicle as claimed in claim 4, in which said walls of said chamber are defined by a cap removably placed on said base.

9. The vehicle as claimed in claim 4, in which said suction device has a plurality of suction inlets positioned and distributed in said base of said chamber.

* * * * *